US007430961B2

(12) United States Patent
Iwamoto

(10) Patent No.: US 7,430,961 B2
(45) Date of Patent: Oct. 7, 2008

(54) METHOD OF AND SYSTEM FOR FORMING IMAGE AND AN EXPENDABLE

(75) Inventor: Manabu Iwamoto, Ami-machi (JP)

(73) Assignee: Riso Kagaku Corporation, Tokyo (JP)

( * ) Notice: Subject to any disclaimer, the term of this patent is extended or adjusted under 35 U.S.C. 154(b) by 237 days.

(21) Appl. No.: 10/545,461

(22) PCT Filed: Dec. 19, 2003

(86) PCT No.: PCT/JP03/16319

§ 371 (c)(1),
(2), (4) Date: Aug. 12, 2005

(87) PCT Pub. No.: WO2004/071778

PCT Pub. Date: Aug. 26, 2004

(65) Prior Publication Data

US 2006/0152537 A1 Jul. 13, 2006

(30) Foreign Application Priority Data

Feb. 17, 2003 (JP) ..... 2003-038119

(51) Int. Cl.
*B41C 1/14* (2006.01)

(52) U.S. Cl. ..... 101/128.4; 101/116; 101/119; 347/7; 347/19; 399/27

(58) Field of Classification Search ..... 101/114, 101/116, 119, 127, 128.21, 128.4, 129; 347/7, 347/19, 85, 86, 87; 399/24, 27, 29
See application file for complete search history.

(56) References Cited

U.S. PATENT DOCUMENTS 4,734,747 A * 3/1988 Okuda et al. ..... 399/23
6,196,670 B1 3/2001 Saruta
6,371,586 B1 4/2002 Saruta
6,447,090 B1 9/2002 Saruta
6,530,519 B1 3/2003 Suzuki
6,631,967 B1 10/2003 Saruta
6,923,531 B2 * 8/2005 Saruta ..... 347/86
6,971,732 B1 12/2005 Seshimo et al.
6,995,861 B1 2/2006 Saruta et al.
7,195,346 B1 * 3/2007 Saruta et al. ..... 347/86
2002/0057319 A1 5/2002 Saruta et al.
2002/0085051 A1 7/2002 Saruta
2002/0180851 A1 12/2002 Saruta (Continued)

FOREIGN PATENT DOCUMENTS

EP 1 004 447 5/2000

(Continued)

*Primary Examiner*—Ren Yan
(74) *Attorney, Agent, or Firm*—Matthew K. Ryan; Frommer Lawrence & Haug LLP

(57) ABSTRACT

To make the stencil printing at a stabilized density from the start of printing in a stencil printing where a plurality of kinds of inks different from each other in volatility and/or viscosity are used. Information representing the volatility and/or viscosity of ink is stored in a storage means of an ink container, while the stored information representing the volatility and/or viscosity of ink is read out, and at the same time, the ceasing time from interruption of printing to resumption of the same is measured, and the printing pressure is controlled according to the ceasing time and the information representing the volatility and/or viscosity of ink.

7 Claims, 3 Drawing Sheets

U.S. PATENT DOCUMENTS

| | | | |
|---|---|---|---|
| 2002/0196302 | A1 | 12/2002 | Saruta |
| 2003/0007027 | A1 | 1/2003 | Saruta |
| 2003/0058297 | A1 | 3/2003 | Saruta |

FOREIGN PATENT DOCUMENTS

| | | |
|---|---|---|
| JP | 4-49400 | 4/1992 |
| JP | 2000-218818 | 8/2000 |
| JP | 2002-258721 | 9/2002 |
| JP | 2004-62173 | 2/2004 |
| JP | 2004-216624 | 8/2004 |
| JP | 2004-216745 | 8/2004 |

* cited by examiner

FIG.3

| |
|---|
| STORAGE AREA 1(100%) |
| STORAGE AREA 2(99.5%～95%) |
| STORAGE AREA 3(94.5%～90%) |
| STORAGE AREA 4(89.5%～85%) |
| ⋮ |
| STORAGE AREA 21(4.5%～0%) |

METHOD OF AND SYSTEM FOR FORMING IMAGE AND AN EXPENDABLE

FIELD OF THE INVENTION

This invention relates to a method of and system for forming an image which obtains residue data representing a residue of an expendable, records the data on a storage means and forms an image by causing a predetermined object to be controlled to operate on the basis of the recorded residue data, and such an expendable.

BACKGROUND OF THE INVENTION

There have been used expendables in various image forming systems such as a stencil printer, an ink jet recording system and the like for the reason of easiness in handling or the like. For example, in the stencil printer, an expendable such as a removable ink container or a stencil material roll is employed for the reason of easiness in handling or the like. The above-mentioned expendables are generally installed on the system body and are removed when the ink or the stencil material is exhausted after the ink or the stencil material is supplied to be discarded or to recycled. When a new expendable is mounted on the stencil printer, it is possible to continuously make print.

In Japanese Unexamined Patent Publication No. 2001-18507, there is proposed a method where, when forming an image by the use of such expendables, residue data is stored according to the residue of the expendable in, for instance, a memory IC provided on the expendable and the residue data is read out from the memory IC so that the residue of the expendable is displayed.

Further, in Japanese Unexamined Patent Publication No. 2003-7815, there is proposed a method where, when a stencil material roll is used as expendables for a stencil printer, residue data is stored in a memory IC as in the above-mentioned method, the residue data is read out when a stencil is to be made, and the rotational speed of a platen roller for conveying the stencil is controlled to be according to the residue data. The reason why the rotational speed of the platen roller is controlled according to the residue data is that though, when the stencil is conveyed, a tension is provided to the stencil in a direction reverse to the direction of conveyance so that the stencil is not wrinkled, the stencil material roll is gradually reduced in its diameter as the stencil material roll is consumed, and the tension on the stencil is increased therewith, whereby slip occurs between the platen roller and the stencil and the image on the stencil can be distorted. Accordingly, it is necessary to increase the rotational speed of the platen roller as the diameter of the stencil material roll reduces or the residue data reduces.

Further, in Japanese Unexamined Patent Publication No. 2003-4310, there is proposed a method where residue data of the stencil material roll is stored in a memory IC provided on the stencil material roll as in the above-mentioned method, the residue data is read out, and the operation of a thermal head is controlled with an amount of energy according to the residue data. The reason why the amount of energy of the thermal head is controlled according to the residue data is that since the surface smoothness deteriorates toward the center of the stencil material roll due to, for instance, a winding pressure when the stencil material is rolled into a roll and when the surface smoothness deteriorates, the contact of the stencil material with the thermal head fluctuates. Accordingly, it is necessary to increase the amount of energy of the thermal head as the distance to the center of the stencil material roll reduces or the residue data reduces.

However, in the image forming system where, for instance, the residue of the expendable is displayed on the basis of the residue data stored in a memory IC as described above, though, the preceding residue data is overwritten so that the new residue data is always recorded, a wrong residue can be displayed so that the operation of the platen roller or the thermal head cannot be adequately controlled if, for instance, the power source of the system body is turned off or noise is mixed when the residue data is to be recorded and residue data cannot be correctly recorded in the memory IC.

In view of the foregoing observations and description, the primary object of the present invention is to provide an image forming method, an image forming system and an expendable which permit, in those where the residue of an expendable is displayed or operation of the platen roller or the thermal head is controlled on the basis of residue data recorded in a memory IC as described above, adequate control of the part of the system even if the power source of the system body is turned off or noise is mixed when the residue data is to be recorded in the memory IC and residue data cannot be correctly recorded in the memory IC.

SUMMARY OF THE INVENTION

In accordance with the present invention, there is provided an image forming method comprising, in a method where residue data representing a residue of an expendable is obtained, the obtained residue data is recorded in a storage means, the recorded residue data is read out from the storage means, and operation of a predetermined object to be controlled operation of which is to be controlled in relation to the residue of the expendable is controlled on the basis of the read-out residue data, the steps of dividing the residue of the expendable into n(n standing for an integer not smaller than 2) residue ranges Hi (i=1 to n), setting n storage areas, which correspond to the respective residue ranges and in which pieces of residue data for the corresponding residue ranges are recorded, in the storage means, and recording pieces of residue data in sequence in the storage areas corresponding to the residue of the expendable as reduction of residue of the expendable while, when the residue is shifted from a predetermined residue range Hi to the next residue range Hi+1, making unwritable the storage area corresponding to the former residue range Hi, and when the residue data read out from a storage area which has not been made unwritable yet is determined to be not regular, reading out the residue data recorded in the storage area which has been made unwritable last.

The "expendable" may be any so long as the predetermined object to be controlled is controlled on the basis of its residue. For example, the "expendable" may be a stencil material roll or an ink container holding therein ink in a stencil printer or an ink container holding therein ink in an ink jet recording system.

Further, "a predetermined object to be controlled operation of which is to be controlled in relation to the residue of the expendable" may be any so long as it is controlled on the basis of the residue of the expendable. For example, when the expendable is a stencil material roll, it may be a thermal head the heating energy to which is controlled on the basis of the residue of the stencil material roll, a platen roller the rotational speed of which is controlled on the basis of the residue of the stencil material roll and a display means for displaying the residue of the stencil material roll. When the expendable is an ink container, it may be a display means for displaying the number of copies which can be further printed on the basis of the residue of the ink in the ink container.

Further, "dividing the residue of the expendable into n(n standing for an integer not smaller than 2) residue ranges Hi (i=1 to n) means, for instance, that the residue from 0% to 100% is divided into residue ranges not less than 0% to less than 10%, not less than 10% to less than 20%, . . . not less than 80% to less than 90%, and not less than 90% to less than 100% that is, that the residue is divided into n residue ranges with a range of continuous residues taken as one division.

The "residue data" may include data indirectly representing the residue of the expendable, e.g., the value obtained by cumulatively adding up the consumption of the expendable as well as the residue itself of the expendable. That is, the value obtained by cumulatively adding up pieces of consumption data representing consumption of the expendable may be stored in each of the storage areas.

In accordance with the present invention, there is further provided an image forming system comprising a residue data obtaining means which obtains residue data representing a residue of an expendable, a residue data recording means which records in a storage means the residue data obtained by the residue data obtaining means, a read out means which reads out the residue data recorded in the storage means by the residue data recording means, and a control means which controls operation of a predetermined object to be controlled operation of which is to be controlled in relation to the residue of the expendable on the basis of the residue data read out by the read out means, thereby causing the predetermined object to be controlled to operate on the basis of the residue data by the control means, wherein the improvement comprises that the residue of the expendable is divided into n(n standing for an integer not smaller than 2) residue ranges Hi (i=1 to n), and n storage areas, which correspond to the respective residue ranges and in which pieces of residue data for the corresponding residue ranges are recorded, are set in the storage means, and the residue data recording means records pieces of residue data in sequence in the storage areas corresponding to the residue of the expendable as reduction of residue of the expendable while, when the residue is shifted from a predetermined residue range Hi to the next residue range Hi+1, the residue data recording means makes unwritable the storage area corresponding to the former residue range Hi, and when the residue data read out from a storage area which has not been made unwritable yet is determined to be not regular, the read out means reads out the residue data recorded in the storage area which has been made unwritable last.

In the image forming system, the storage means may be provided in the expendable.

In accordance with the present invention, there is further provided an expendable which is used for carrying out the image forming method and comprises a storage means in which n storage areas have been set.

In accordance with the image forming method and system and the expendable of the present invention, the residue of the expendable is divided into n(n standing for an integer not smaller than 2) residue ranges Hi (i=1 to n), n storage areas, which correspond to the respective residue ranges and in which pieces of residue data for the corresponding residue ranges are recorded, are set in the storage means, and pieces of residue data are recorded in sequence in the storage areas corresponding to the residue of the expendable as reduction of residue of the expendable while, when the residue is shifted from a predetermined residue range Hi to the next residue range Hi+1, the storage area corresponding to the former residue range Hi is made unwritable, and when the residue data read out from a storage area which has not been made unwritable yet is determined to be not regular, the residue data recorded in the storage area which has been made unwritable last is read out.

Accordingly, even if the power source of the system body is turned off or noise is mixed when the residue data is to be recorded in the storage means and residue data cannot be correctly recorded in the storage means, the action of the system can be adequately controlled on the basis of residue data by using the residue data which is stored in the storage area which has been made unwritable last and is regular and less in errors.

Further, when the storage means is provided in the expendable in the image forming system, adequate residue data can be obtained by reading out the residue data recorded in the storage means even if an expendable whose residue data has not been recorded in the system body is mounted on the system body.

BRIEF DESCRIPTION OF THE DRAWINGS

FIG. 3 is a view showing the recording areas of the storage means 70 shown in FIG. 2.

PREFERRED EMBODIMENTS OF THE INVENTION

Figure 1:
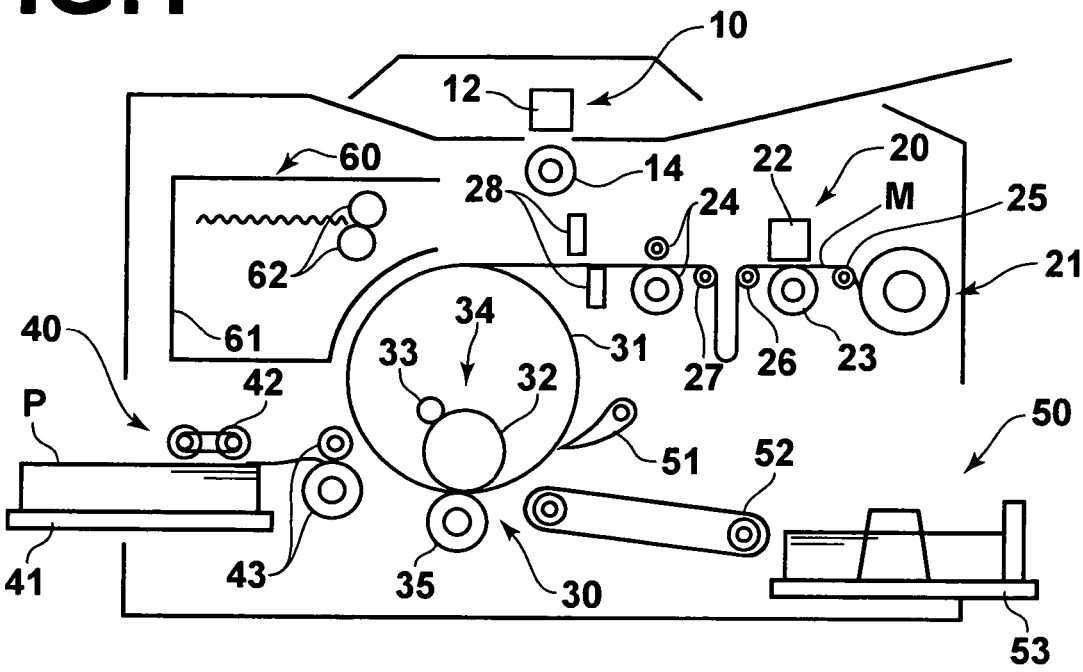
FIG. 1 is a view showing in brief a stencil printer employing an image forming system in accordance with an embodiment of the present invention.

A stencil printer using an image forming system in accordance with an embodiment of the present invention will be described, hereinbelow, with reference to the drawings. FIG. 1 is a view showing in brief the stencil printer.

As shown in FIG. 1, the stencil printer comprises a reading portion 10 which reads out an image on an original, a stencil making portion 20 which makes a stencil M from stencil material on the basis of the image information read by the reading portion 10, a printing portion 30 which prints on a printing paper by the use of the stencil M made by the stencil making portion 20, a paper supply portion 40 which supplies the printing paper to the printing portion 30, a paper discharge portion 50 which discharges the printed printing paper from the printing portion 30, and a stencil discharge portion 60 which discharges the stencil M after use.

The image read-out portion 10 is an image scanner and comprises an image line sensor 12 which reads out an image on an original conveyed in a sub-scanning direction, and original feed rollers 14.

The stencil making portion 20 comprises a stencil material roll portion 21, a thermal head 22 where plurality of heater elements are arranged in a row, a platen roller 23, stencil material feed rollers 24, stencil material guide rollers 25, 26 and 27, and a stencil cutter 28. In the stencil making portion 20, a stencil M is made by conveying the stencil material by, for instance, the platen roller 23 and pressing the stencil material against the thermal head 22 for thermal perforation by the platen roller 23.

Figure 2:
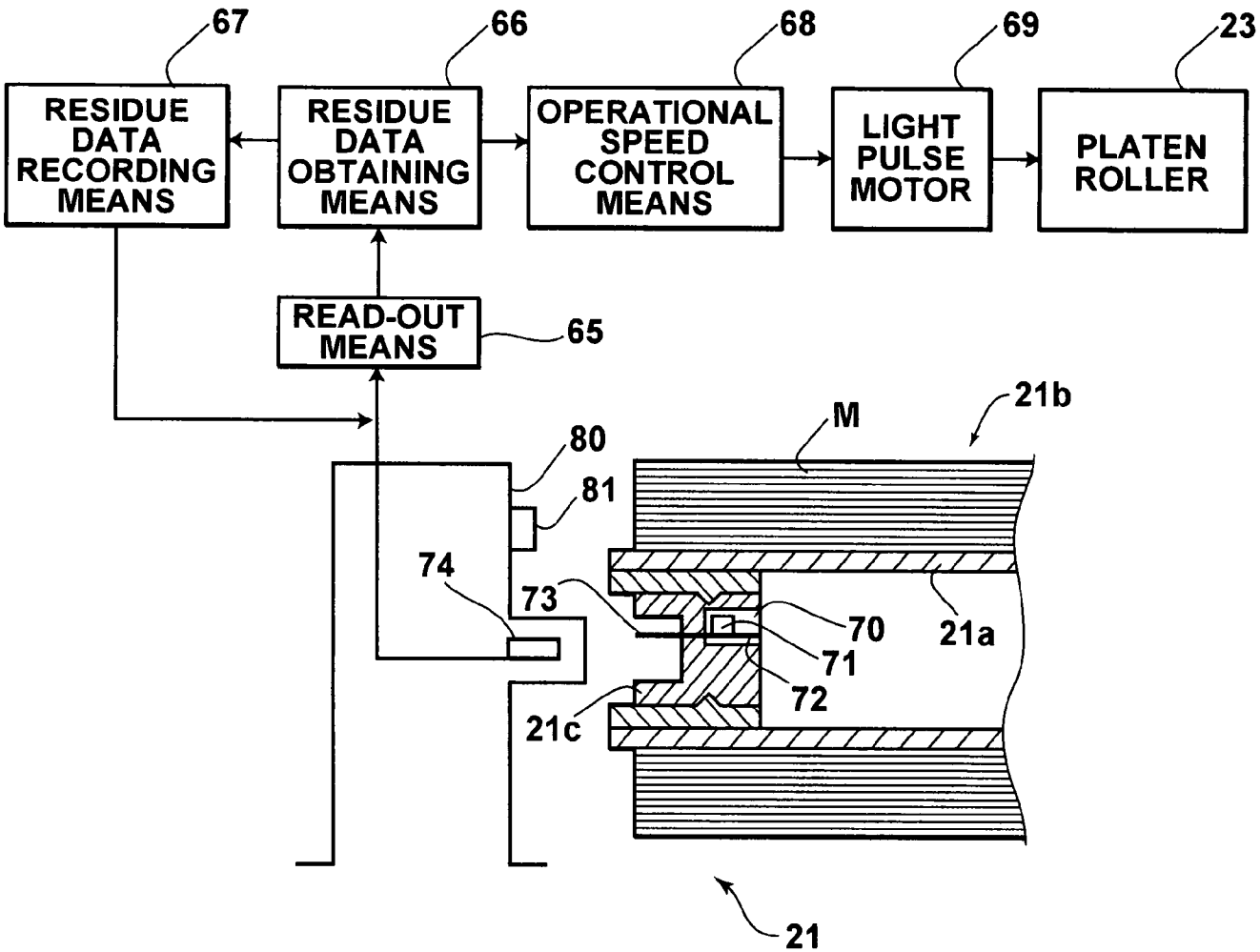
FIG. 2 is a block diagram of a part of the stencil printer shown in FIG. 1.

As shown in FIG. 2, in the stencil material roll portion 21, a stencil material roll 21*b* comprising stencil material M wound around a paper core 21*a* is mounted on a master holder 80 to be changeable. A storage means 70 which stores a total length of the stencil material M in the stencil material roll 21*b* before use and the residue of the stencil material M after use of the stencil material roll 21*b* is disposed in a support member 21*c* mounted for rotation on one end portion of the paper core 21*a*. The storage means 70 comprises a memory IC 71 forming a non-volatile memory (e.g., an EEPROM) which can hold data for a predetermined time without power supply, and a contact 73 is provided on the tip of a board 72 on which the memory IC 71 is mounted. Further, as shown in FIG. 2, a connector 74 to be electrically connected to the contact 73 of the storage means 70 of the stencil material roll 21*b* is disposed in the master holder 80.

Further, the memory IC 71 is formed by a plurality of storage areas 1 to 21 as shown in FIG. 3, and a value of 100% is stored in the storage area 1 as information representing the total length of the stencil material M before use. Residue data of the stencil material M is stored in each of the storage areas 2 to 21 in percentage. The method of storage will be described later.

Further, the stencil printer of this embodiment is provided with the read-out means 65 which reads out the residue data stored in the storage means 70 each time a stencil is made, a residue data obtaining means 66 which obtains the residue of the stencil material roll 21*b* in percentage by cumulatively subtracting 0.5% that is, the proportion of the length of the stencil to the total length of the stencil material roll 21*b* from the total length of the stencil material roll 21*b* read out by the read-out means 65 (in this embodiment, it is assumed that two hundreds of stencils can be made from one stencil material roll 21*b*, a residue data recording means 67 which records the residue data obtained by the residue data obtaining means 66 in the corresponding storage areas 2 to 21 of the storage means 70 and at the same time makes unwritable the preceding storage area when the residue data obtained by the residue data obtaining means 66 is shifted to be recorded in the next storage area, an operational speed control means 68 which changes the rotational speed of the platen roller 23 by changing the frequency of a light pulse motor 69 (to be described later) on the basis of the residue data obtained by the residue data obtaining means 66 and the light pulse motor 69 which rotates on the basis of the frequency output from the operational speed control means 68. The platen roller 23 rotates in response to rotation of the light pulse motor 69.

The master holder 80 is provided with a silicone damper 81 which controls rotation of the paper core 21*a* so that tension is generated in the stencil material M unrolled from the stencil material roll 21*b* in the direction reverse to the direction in which the stencil material M is conveyed. Due to the back tension generated in the stencil material M by the silicone damper 81, the stencil material M is suppressed from being wrinkled. As the diameter of the stencil material roll is reduced, the above-mentioned back tension increases, that is, as the residue of the stencil material roll 21*b* is reduced, the back tension increases to generate slip of the stencil material M on the platen roller 23, whereby the conveying speed of the stencil material M is slowed with respect to the timing at which the thermal head 22 generates heat and the image on the stencil is shrunk. Accordingly, the operational speed control means 68 controls the rotational speed of the platen roller so that the conveying speed of the stencil material M is held constant. That is, the operational speed control means 68 controls the rotational speed of the platen roller 23 to increase as the residue of the stencil material roll 21*b* is reduced. The operational speed control means 68 is provided with a table in which a drive frequency of the light pulse motor 69 corresponding to the residue of the stencil material roll 21*b* is set.

The printing portion 30 comprises a cylindrical ink-transmittable printing drum 31 which is formed of a porous metal plate or a mesh structure, an ink supply system 34 having a squeegee roller 32 and a doctor roller 33 which are disposed inside the printing drum 31, and a press roller 35. The stencil is wound around outer periphery of the printing drum 31.

The paper supply portion 40 comprises a paper supply table 41 on which printing papers P are stacked, a pair of pick-up rollers 42 which take out the printing papers P one by one from the paper supply table 41, and a pair of timing rollers 43 which sends a printing paper P between the printing drum 31 and the press roller 35.

The paper discharge portion 50 comprises a separator 51 which peels off printing paper P from the printing drum 31, a paper discharge belt portion 52, and a paper discharge table 53 on which the printed printing papers P are stacked.

The stencil discharge portion 60 comprises a stencil discharge box 61 which is disposed on one side of the printing portion 30 and in which the stencil M peeled off the printing drum 31 is placed, and a pair of stencil discharge rollers 62 which peel the stencil M off the printing drum 31 after use and convey the stencil M peeled off the printing drum 31 into the stencil discharge box 61.

Operation of the stencil printer of this embodiment will be described, hereinbelow.

A stencil material roll 21*b* is first installed on the master holder 80 and the stencil material M is unrolled from the stencil material roll 21*b* in a length corresponding to one stencil which has been set in advance. Then the stencil material M is guided to between the platen roller 23 and the thermal head 22 by the guide roller 25.

In response to installment of the stencil material roll 21*b* on the master holder 80, the connector 74 on the master holder 80 is electrically connected to the contact 73 of the storage means 70 provided on the stencil material roll 21*b*, whereby a value of 100% representing the total length of the stencil material roll M before use which is stored in the storage area 1 of the storage means 71 is read out by the read-out means 65. The value is output to the residue data obtaining means 66 from the read-out means 65 and the residue data obtaining means 66 outputs the residue data of 100% to the operational speed control means 68 and at the same time outputs the residue data of 99.5% obtained by subtracting 0.5% from 100% to the residue data recording means 67. The residue data recording means 67 outputs the residue data of 99.5% to the storage area 2 of the storage means 70 by way of the connector 74 and the contact 73 to record the same therein. When stencil making action is started next, the read-out means 65 reads out the residue data of 99.5% stored in the storage area 2 of the storage means 70 and outputs the value to the residue data obtaining means 66. The residue data obtaining means 66 outputs the value to the operational speed control means 68 and at the same time outputs the residue data of 99% obtained by subtracting 0.5% from 99.5% to the residue data recording means 67. The residue data recording means 67 outputs the residue data of 99% to the storage area 2 of the storage means 70 by way of the connector 74 and the contact 73 to update the preceding residue data of 99.5%.

Each time a stencil is made, 0.5% is subtracted to calculate the residue data and the residue data is recorded in the storage means 70. Until the residue data becomes 95%, the preceding residue data in the storage area 2 is overwritten. When the residue data becomes 94.5%, the residue data is stored in the storage area 3 and the storage area 2 is made unwritable with the residue data of 95% held therein. The residue data is recorded in the next storage area each time the residue reduces by 4.5% in the manner described above. Then each time the storage areas are switched, the storage area in which the residue data has been recorded is set unwritable. Though the residue data is overwritten in sequence in one storage area in this particular embodiment, another piece of residue data may be recorded in addition to the piece(s) of preceding residue data.

Each time stencil making is carried out, the read-out means reads out the residue data from the storage means 70 and outputs the residue data read out to the residue data recording means 67 and to the operational speed control means 68. At this time, the read-out means 65 checks all the pieces of residue data read out whether the residue data has been regularly stored except that it reads out a residue data representing 100% from the storage area 1. That is, the residue data calculated in the residue data obtaining means 66 is attached with a check sum upon calculation thereof, and the check sum is output together with the residue data when the residue data recording means 67 outputs the residue data to the storage means 70. The residue data recording means 67 records the residue data in the corresponding storage area in the manner described above and at the same time records the check sum linked with the residue data. However, the check sum is stored in the storage area different from that in which the residue data is stored. When residue data is read out from the storage area of the storage means 70, the check sum linked with the residue data is read out together with the residue data, and the check sum read out is compared with a check sum calculated from the residue data read out. When they are different from each other, it is determined that the residue data has not been correctly recorded in the storage means 70. When it is determined that the residue data has not been correctly recorded in the storage means 70, the read-out means 65 reads out the residue data in the storage area which has been made unwritable last and outputs the residue data to the residue data obtaining means 66. The residue data obtaining means 66 calculates residue data on the basis of the input residue data in the manner described above and outputs the calculated residue data to the residue data recording means 67 and the operational speed control means 68. For example, in the case where, when the read-out means 65 reads out the residue data stored in storage area 3, it is determined that the residue data has not been correctly stored in the storage area 3, residue data of 95% stored in the storage area 2 which has been made unwritable is read out (When a plurality of pieces of residue data have been additionally recorded in the storage area 2, the least residue data in the plurality of pieces of residue data is read out) and output to the residue data obtaining means 66. The residue data obtaining means 66 calculates residue data on the basis of the input residue data in the manner described above and outputs the calculated residue data to the residue data recording means 67 and the operational speed control means 68.

The operational speed control means 68 obtains a drive frequency by referring to the table on the basis of the residue data thus input. Then the operational speed control means 68 outputs the obtained drive frequency to the light pulse motor 69. The light pulse motor 69 rotates on the basis of the drive frequency thus input and rotates the platen roller 23. The stencil material M guided to between the platen roller 23 and the thermal head 22 is pressed against the thermal head 22 by the platen roller 23 and at the same time, is conveyed by rotation of the platen roller 23 whose rotational speed is controlled as described above. Then while conveyed, the stencil material M is thermally perforated by the thermal head 22, and thereafter conveyed to the stencil cutter 28 byway of the stencil guide roller 26 and 27 and the stencil material feed rollers 24. The stencil material M is cut by the stencil cutter 28 into a stencil and the stencil is wound around the printing drum 31.

Then ink in a predetermined color is supplied inside the printing drum 31 by the ink supply system 34. As the printing drum 31 is rotated in the counterclockwise direction as seen in FIG. 1, a printing paper P is moved left to right as seen in FIG. 1 by the timing rollers 43 to be supplied between the printing drum 31 and the press roller 35 at a predetermined timing in synchronization with the rotation of the printing drum 31. The printing paper P is subsequently pressed by the press roller 35 against the stencil on the outer peripheral surface of the printing drum 31, whereby the printing paper P is printed with the ink in the predetermined color.

In accordance with the stencil printer described above, the residue of the expendable is divided into a plurality of residue ranges, a plurality of storage areas 1 to 21, which correspond to the respective residue ranges and in which pieces of residue data for the corresponding residue ranges are recorded, are set in the storage means 70, and pieces of residue data are recorded in sequence in the storage areas corresponding to the residue of the expendable as reduction of residue of the expendable while, when the residue is shifted from a predetermined residue range Hi to the next residue range Hi+1, the storage area corresponding to the former residue range Hi is made unwritable, and when the residue data read out from a storage area which has not been made unwritable yet is determined to be not regular, the residue data recorded in the storage area which has been made unwritable last is read out.

Accordingly, even if the power source of the system body is turned off or noise is mixed when the residue data is to be recorded in the storage means and residue data cannot be correctly recorded in the storage means, the action of the system can be adequately controlled on the basis of residue data by using the residue data which is stored in the storage area which has been made unwritable last and is regular and less in errors.

Though the rotational speed of the platen roller 23 is controlled on the basis of the residue data calculated in the residue data obtaining means 66 in the embodiment described above, for instance, the amount of energy of the thermal head without limited to the rotational speed of the platen roller 23 may be controlled according to the residue data. In this case, the amount of energy of the thermal head is increased as the residue data becomes smaller.

Though calculation of the residue data when a stencil material roll is used as the expendable is described in conjunction with the above embodiment, an ink container filled with ink may also be used as the expendable without limited to the stencil material roll. In this case, the ink container is provided with a storage means such as a memory IC, the residue of ink in the ink container is detected by a predetermined residue detecting means, and the ink residue data is recorded in a corresponding one of a plurality of storage areas in the storage means according to consumption of the ink as in the above embodiment. Then, for instance, a number of copies which can be printed may be calculated on the basis of the stored ink residue and may be displayed.

Further, the image forming system of the present invention may be applied also to an ink jet recording system without limited to the stencil printer described above. In the ink jet recording system, a recording head and an ink reservoir are formed integrally and mounted on a carriage, and an image is formed by moving the carriage in a main scanning direction and a sub-scanning direction at a preset speed. However, the weight of the carriage differs according the amount of ink in the ink reservoir and the speed of movement of the carriage depends on the residue of ink in the ink reservoir, which makes it impossible to make constant the impact position of ink. The impact position of ink can be made constant by controlling the speed of movement of the carriage according to the residue of ink in the ink reservoir. Also in so controlling the speed of movement of the carriage, a storage means such as a memory IC is provided to store the residue data of ink in the ink reservoir and the ink residue data is recorded in a corresponding one of a plurality of storage areas in the storage means according to consumption of the ink as in the above embodiment. Then, for instance, the speed of movement of the carriage may be controlled on the basis of the stored ink residue.

Though a memory IC is employed as the storage means in the above embodiment, the storage means may be any so long as the storage area can be divided into a plurality of areas so that residue data of the residue ranges can be stored therein and read out therefrom and the storage area(s) described above can be made unwritable.

The invention claimed is:

1. An image forming system comprising a residue data obtaining means which obtains residue data representing a residue of an expendable, a residue data recording means which records in a storage means the residue data obtained by the residue data obtaining means, a read out means which reads out the residue data recorded in the storage means by the residue data recording means, and a control means which controls operation of a predetermined object to be controlled operation of which is to be controlled in relation to the residue of the expendable on the basis of the residue data read out by the read out means, thereby causing the predetermined object to be controlled to operate on the basis of the residue data by the control means, wherein the improvement comprises that the residue of the expendable is divided into n(n standing for an integer not smaller than 2) residue ranges Hi (i=1 to n), and n storage areas, which correspond to the respective residue ranges and in which pieces of residue data for the corresponding residue ranges are recorded, are set in the storage means, and the residue data recording means records pieces of residue data in sequence in the storage areas corresponding to the residue of the expendable as reduction of residue of the expendable while, when the residue is shifted from a predetermined residue range Hi to the next residue range Hi+1, the residue data recording means makes unwritable the storage area corresponding to the former residue range Hi, and when the residue data read out from a storage area which has not been made unwritable yet is determined to be not regular, the read out means reads out the residue data recorded in the storage area which has been made unwritable last.

2. An image forming system as defined in claim 1 in which the storage means is provided in the expendable.

3. An image forming system as defined in claim 1 in which the image forming system is a stencil printer which forms an image by the use of a stencil, the expendable is a stencil material roll into which a stencil material is rolled, the object to be controlled is a platen roller which conveys the stencil material of the stencil material roll, and the control means controls the rotational speed of the platen roller on the basis of the residue data.

4. An image forming system as defined in claim 1 in which the image forming system is a stencil printer which forms an image by the use of a stencil, the expendable is a stencil material roll into which a stencil material is rolled, the object to be controlled is a thermal head which perforates the stencil material of the stencil material roll, and the control means controls the amount of energy of the thermal head on the basis of the residue data.

5. An image forming system as defined in claim 1 in which the image forming system is an ink jet recording system which forms an image by moving a recording head, the expendable is an ink container filled with ink to be used in the image formation, the object to be controlled is a carriage on which the ink container and the recording head for forming an image are mounted, and the control means controls the moving speed of the carriage on the basis of the residue data.

6. An image forming system as defined in claim 1 in which the expendable is an ink container filled with ink to be used in the image formation, the object to be controlled is a display means which displays the number of copies to be printable, and the control means causes the display means to display the number of copies to be printable on the basis of the residue data.

7. An image forming system as defined in claim 1 in which said storage means comprises a memory IC.

* * * * *